US006824576B2

(12) United States Patent
Lightner

(10) Patent No.: US 6,824,576 B2
(45) Date of Patent: Nov. 30, 2004

(54) HYDROGEN PRODUCED FROM HETEROCYCLIC COMPOUNDS

(76) Inventor: Gene E Lightner, 706 SW. 296th St., Federal Way, WA (US) 98023

( * ) Notice: Subject to any disclaimer, the term of this patent is extended or adjusted under 35 U.S.C. 154(b) by 747 days.

(21) Appl. No.: 09/823,018

(22) Filed: Mar. 30, 2001

(65) Prior Publication Data

US 2002/0139050 A1 Oct. 3, 2002

(51) Int. Cl.[7] ..... B01J 8/02; C01B 1/02
(52) U.S. Cl. ..... 48/127.9; 423/648.1; 48/61
(58) Field of Search ..... 48/127.9, 62 R; 423/650, 648.1, 359; 95/10.1; 127/37; 208/212

(56) References Cited

U.S. PATENT DOCUMENTS 3,699,218 A * 10/1972 Smith et al. ..... 423/650
4,553,981 A * 11/1985 Fuderer ..... 48/62 R
5,531,809 A * 7/1996 Golden et al. ..... 95/101
6,007,636 A * 12/1999 Lightner ..... 127/37
6,207,132 B1 * 3/2001 Lin et al. ..... 423/648.1
6,228,254 B1 * 5/2001 Jossens et al. ..... 208/212
6,599,491 B2 * 7/2003 Vidalin ..... 423/359
6,641,625 B1 * 11/2003 Clawson et al. ..... 48/127.9

* cited by examiner

*Primary Examiner*—Glenn Caldarola
*Assistant Examiner*—Tom Duong

(57) ABSTRACT

Heterocyclic compounds containing furfural and hydroxymethylfurfural are derived from acidic hydrolysis of biomass. Heterocyclic compounds are vaporized and subjected to reforming and steam shifting to produce a gas containing hydrogen, carbon dioxide and carbon monoxide. The gas containing hydrogen, carbon dioxide and carbon monoxide is scrubbed by a solvent, capable of dissolving carbon monoxide, to produce a gas containing hydrogen, carbon dioxide and substantially devoid of carbon monoxide. The solvent containing dissolved carbon monoxide is heated to provide a solvent for scrubbing and a vapor containing carbon monoxide recycled for additional steam shifting. The gas containing hydrogen, carbon dioxide substantially devoid of carbon monoxide, is further scrubbed of carbon dioxide to produce a gas substantially devoid of carbon monoxide and substantially devoid of carbon dioxide containing hydrogen suitable for use in a fuel cell.

17 Claims, 2 Drawing Sheets

HYDROGEN PRODUCED FROM HETEROCYCLIC COMPOUNDS

BACKGROUND OF THE INVENTION

Present day motor vehicles employ internal combustion engines operating with petroleum based fuels. In the future internal combustion engines will, in all likelihood, be replaced with other power sources such as hydrogen based fuel cells portrayed by Argonne National laboratory in "Fuel Reformer Brings Practical Electric Cars Closer," in which development of a partial oxidation methanol reformer is discussed. A state of the art process and apparatus for methanol reforming to form hydrogen is depicted in U.S. Pat. No. 5,989,503. Energy for this reforming is furnished from external heat from an oil heating circuit. Several state of the art methods for forming hydrogen employing a steam reformer are described in U.S. Pat. Nos. 5,997,594, 5,639,431, and 5,938,800 converting fuel to form hydrogen. A state of the art method, employing a reformer for forming hydrogen from bio-oil from pyrolysis of a biomass is disclosed by Wang et al within Energy and Fuels; 12(1): 19–24 (January–February 1998). The hydrogen will be used to supply power for motor vehicles and to form a water vapor which is pollution free. A mobile supply of hydrogen gas containing carbon monoxide and carbon dioxide is supplied from a fuel by a mobile reformer. The gas from the reformer commonly contains toxic carbon monoxide which should conceivably be converted to non toxic carbon dioxide. The resulting hydrogen gas is often separated by a membrane, permeable to hydrogen, to provide power to a fuel cell located in a vehicle.

It is therefore an object of this invention to obviate many of the limitations or disadvantages of the prior art.

The present concern is about producing hydrogen from a gas containing carbon monoxide derived from reforming without employing a hydrogen permeable membrane.

A distinct object of this invention is to dissolve carbon monoxide contained in a gas derived from fuel reforming in a solvent to thus extract carbon monoxide from the gas.

Still another object of this invention is to provide heterocyclic compounds derived from acidic hydrolysis of biomass.

Yet another object of this invention is to provide hydrogen to power a fuel cell located within a vehicle to generate electrical power.

With the above and other objects in view, this invention relates to the novel features and alternatives and combinations presently described in the brief description of the invention.

APPLICATIONS AND BACKGROUND OF THE INVENTION

One example of steam reforming hydrocarbons is described on page 135 in Chemical Process Industries, second edition, authored by R. N. Shreve, in which propane is employed to produce hydrogen and carbon dioxide and carbon monoxide. Steam forming of furfural, derived from pyrolysis of biomass to produce an oil, formation of hydrogen is disclosed in Proceedings of the US DOE Hydrogen Program Review, Volume II. page 876.

Several solvents to dissolve carbon monoxide are disclosed in the Merck index, eighth edition, 1968, pages 208–209. Inorganic solvents include a concentrated solvent of $NH_4OH$ in addition to cuprous chloride in HCl and organic solvents such as ethyl acetate, dichloromethane and acetic acid. Organic solvents, capable of dissolving carbon monoxide, are selected from the group consisting of ethyl acetate and acetic acid including an individual or a combination thereof. Consequently a gas containing carbon monoxide can be substantially freed of carbon monoxide by employing a solvent capable of dissolving carbon monoxide. The gas, substantially devoid of carbon monoxide, presumably contains carbon dioxide and can be scrubbed.

One example of scrubbing a gas containing carbon dioxide is described by Shreve, op.cit. pages 126 and 128, in which sodium carbonate is employed for scrubbing a flue gas containing carbon dioxide to form water soluble sodium bicarbonate. The solution containing sodium bicarbonate is then heated to produce concentrated gaseous carbon dioxide and a solution containing sodium carbonate to be recycled. Shreve, op.cit. pages 131 and 132, describes a method to scrub a gas containing carbon dioxide in an aqueous solution of monoethanolamine, to provide a solution, in which the carbon dioxide is removed from the aqueous solution to produce carbon dioxide as a gas. The solution for scrubbing and removing carbon dioxide is often selected from the group consisting of aqueous bases and aqueous salts including an individual or combination of these.

Shifting a gas obtained from a reformer containing hydrogen and carbon monoxide is customarily achieved with water as steam to shift carbon monoxide to carbon dioxide and hydrogen. Steam is reacted with carbon monoxide to convert carbon monoxide, reversibly, to carbon dioxide and hydrogen, as described by Shreve, op. cit., page 136.

Heterocyclic compounds such as furfural and hydroxymethylfurfural can be derived from acidic hydrolysis of biomass. Heterocyclic compounds having five rings of four carbon atoms and one oxygen atom consisting of furfural and hydroxymethylfurfural are described in Organic Chemistry, 1948, authored by Hill and Kelley, page 778 and pages 780–781

BRIEF DESCRIPTION OF THE INVENTION

The present invention, in its broadest aspect, is a method to form hydrogen by subjecting volatile heterocyclic compounds vapor and water vapor to catalytic reforming and steam shifting. Reformed gas resulting will produce a gas containing hydrogen and carbon monoxide. Previously reformed gas containing hydrogen and carbon monoxide is subjected to catalytic steam shifting to substantially convert said carbon monoxide to carbon dioxide. Heterocyclic compounds and water are vaporized from sensible heat, of the previously steam shifted gas containing remaining carbon monoxide, to form heterocyclic vapor and water vapor and a gas of reduced sensible heat. The previously reduced sensible heat steam shifted gas containing hydrogen and remaining carbon monoxide, from steam shifting, is scrubbed by a solvent capable of dissolving carbon monoxide to from a solvent containing dissolved carbon monoxide and a gas containing hydrogen substantially devoid of carbon monoxide. Upon heating, the solvent containing dissolved carbon monoxide will produce carbon monoxide for recycle to steam shifting and a solvent capable of dissolving carbon monoxide. The previously scrubbed gas containing hydrogen, substantially devoid of carbon monoxide containing carbon dioxide, is scrubbed with a solution capable of withdrawal of carbon dioxide from the gas. The solution, upon heating, will remove gaseous carbon dioxide from the solution and furnish a solution for recycle. Resulting scrubbed gas containing hydrogen substantially devoid of carbon dioxide is available for employment in a fuel cell.

Characteristics of the invention include;

Production of hydrogen substantially devoid of carbon gases.

Heterocyclic compounds are converted to form hydrogen and carbon monoxide by a reformer.

Vaporizing heterocyclic compounds and water from sensible heat of the gas containing remaining carbon monoxide to form heterocyclic compounds vapor and water vapor.

Conversion of carbon monoxide, contained in reformer gas, to hydrogen and carbon dioxide utilizing water vapor.

Water vapor and heterocyclic compounds vapor are subjected to temperature control.

Hydrogen may be concentrated by an adsorbent selected from the group consisting of activated charcoal and structured carbon including an individual or a combination thereof Reformer is restrained in a container located in a vehicle.

Providing hydrogen from a reformer, separated from carbon gases, to produce hydrogen to power a fuel cell located in a vehicle to generate electrical power regulated upon demand.

BRIEF DESCRIPTION OF THE DRAWINGS

The features that are considered characteristic of this invention are set forth in the appended claims. This invention, however, both as to its origination and method of operations as well as additional advantages will best be understood from the following description when read in conjunction with the accompanying drawings in which:

DETAILED DESCRIPTION OF THE PREFERRED EMBODIMENT

Figure 1:
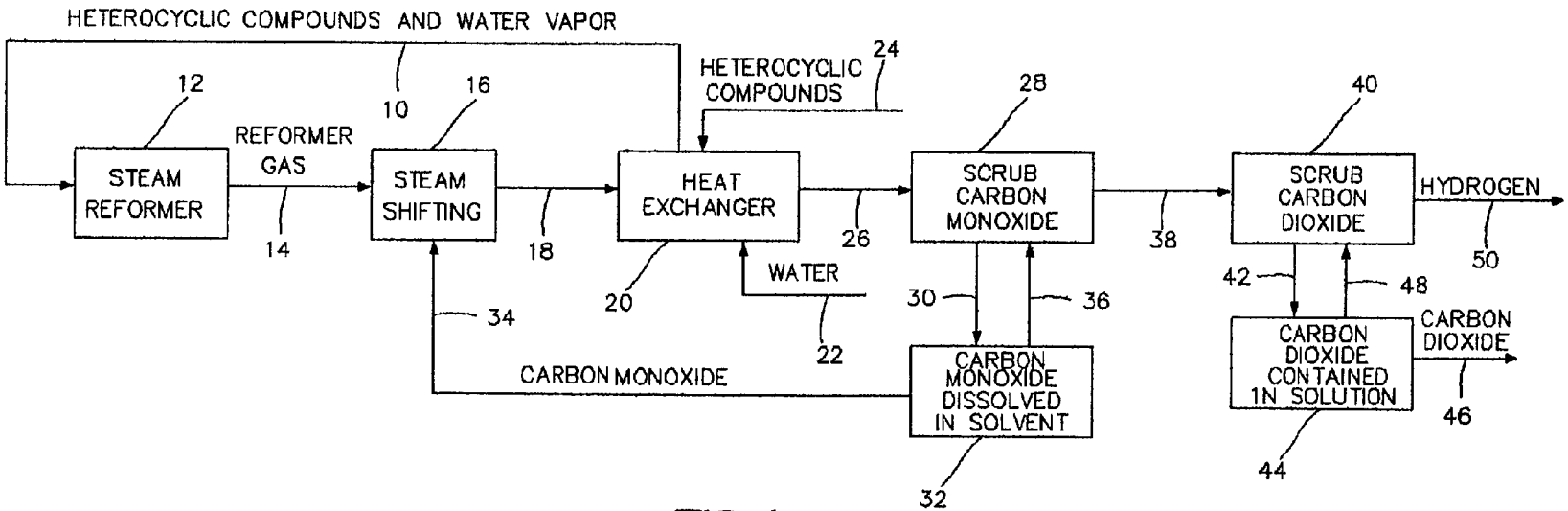
FIG. 1 is a flow sheet denoting the invention as set forth in the appended claims.

The flow diagram of FIG. 1 illustrates the general preferred embodiment of the present invention. In the diagram, rectangles represent stages, operations or functions of the present invention and not necessarily separate components. Details within each stage, operations or functions are not shown. Arrows indicate direction of flow of material in the method.

Figure 2:
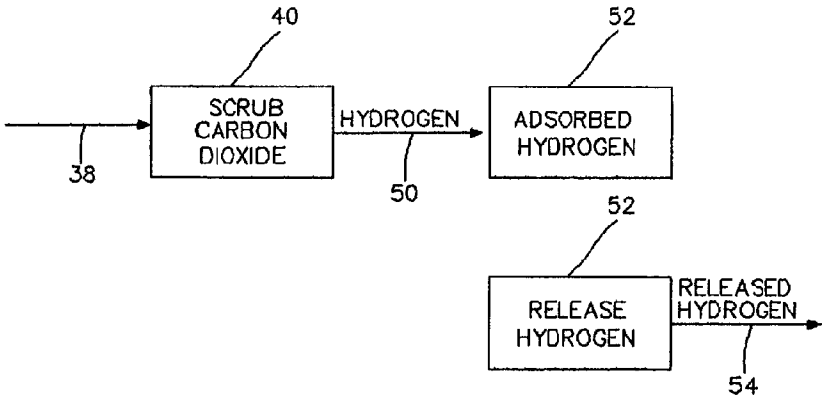
FIG. 2 is a flow sheet denoting a method to store and release hydrogen.

Referring to FIG. 1, a method is depicted to produce hydrogen from a reformer. Heterocyclic compounds and water vapor 10, are transported to steam reformer stage containing a catalyst 12, to produce reformer gas 14. The reformer gas 14 is advanced to steam shifting stage containing a catalyst 16, to shift carbon monoxide into carbon dioxide and hydrogen. The resulting gas containing carbon dioxide, remaining carbon monoxide and hydrogen 18 is advanced to heat exchanger stage 20 to vaporize heterocyclic compounds 24 and water 22 to form vapor 10 containing heterocyclic compounds and water vapor. The gas of reduced sensible heat 26 is forwarded to scrub carbon monoxide stage 28 to produce a scrubbed gas containing carbon dioxide and hydrogen 38 and solvent containing dissolved carbon monoxide 30 forwarded to carbon monoxide dissolved in solvent stage 32. Carbon monoxide 34 is released from carbon monoxide dissolved in solvent stage 32 and solvent for reuse capable of dissolving carbon monoxide 36 is forwarded to scrub carbon monoxide stage 28. The previously scrubbed gas 38 is forwarded to scrub carbon dioxide stage 40 to produce scrubbed gas containing hydrogen 50 and carbon dioxide contained in solution 42 conveyed to carbon dioxide contained in solution stage 44. Carbon dioxide 46 is released from carbon dioxide contained in solution stage 44 and solution for scrubbing carbon dioxide from a gas 48 is transported to scrub carbon dioxide stage considerable sensible heat which is exchanged in heat exchange stage 20 to form gas of reduced sensible heat 26. Gas, of reduced sensible heat containing remaining carbon monoxide 26, is dissolved in solvent to remove remaining carbon monoxide from the gas and as a result produce a gas containing solvent within gas 38. Catalysts are routinely heated and supplies heat to vapors. Catalysts are subjected to temperature control to sustain rate of production of hydrogen. Catalysts for reforming and catalysts for steam shifting are frequently combined. Heat required for catalysts is omitted from this disclosure Referring to FIG. 2, a scrubbed gas containing carbon dioxide and hydrogen 38 is subjected to scrub carbon dioxide stage 40 to scrub the gas and produce hydrogen gas substantially devoid of carbon dioxide 50. Gaseous hydrogen 50 is transported to adsorbed hydrogen stage 52 containing an absorption medium for absorbing hydrogen. Upon absorption of hydrogen by the medium, without moving the medium containing adsorbed hydrogen, is contained in release hydrogen stage 52 wherein hydrogen 54 is released. Details of the scrub carbon dioxide stage 40 have been previously revealed.

Figure 3:
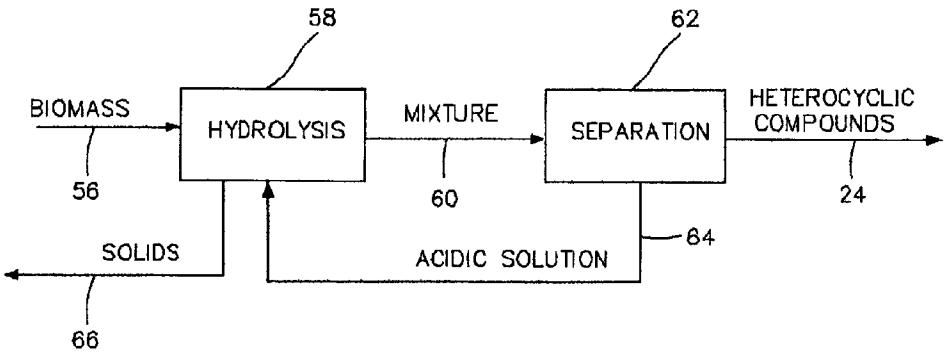
FIG. 3 is a flow sheet denoting a method to produce heterocyclic compounds from a biomass.

Referring to FIG. 3, a supply of biomass containing hemicellulose and cellulose 58 is subjected to hydrolysis stage 58 to hydrolyze biomass and form a mixture of an acidic solution, employed for hydrolysis, and heterocyclic compounds 60 which is sent to a separation stage 62 to separate heterocyclic compounds 24 from acidic solution 64. Solids 66, remaining from hydrolysis of a biomass, are removed from hydrolysis stage 58. Details of the separation stage 62 are unimportant to the function and are accordingly omitted from this disclosure. Thereby heterocyclic compounds are provided from a biomass.

What is claimed is:

1. A method to produce hydrogen from a catalytic reformer by reforming volatile heterocyclic compounds which comprises:

providing said volatile heterocyclic compounds, and producing a vapor containing said heterocyclic compounds and water vapor, and subjecting said vapor to a catalytic reformer to produce a gas containing hydrogen and carbon monoxide, and subjecting the previously reformed gas containing hydrogen and carbon monoxide to catalytic steam shifting to substantially convert said carbon monoxide to carbon dioxide, and vaporizing said heterocyclic compounds and water from sensible heat of the previously steam shifted gas containing remaining carbon monoxide to form heterocyclic vapor and water vapor to form steam shiftect gas reduced sensible heat, and scrubbing the previously reduced sensible heat steam shifted gas containing hydrogen and remaining carbon monoxide, from steam shifting, in a solvent capable of dissolving carbon monoxide to form a solvent containing dissolved carbon monoxide and a gas containing hydrogen substantially devoid of carbon monoxide, and separating the previously scrubbed gas containing hydrogen substantially devoid of carbon monoxide from the solvent containing dissolved carbon monoxide thereby producing a gas containing hydrogen substantially devoid of carbon monoxide.

2. The method of claim 1 wherein said solvent capable of dissolving said carbon monoxide contains cuprous chloride in HCl.

3. The method of claim 1 wherein said solvent capable of dissolving said carbon monoxide contains acetic acid.

4. The method of claim 1 wherein said solvent capable of dissolving carbon monoxide is selected from the organic solvent group consisting of ethyl acetate and acetic acid including an individual or a combination thereof.

5. The method of claim 1 wherein said solvent capable of dissolving carbon monoxide, containing dissolved carbon monoxide, is substantially separated from dissolved carbon monoxide to provide solvent for reuse and carbon monoxide to be recycled for additional steam shifting.

6. The method of claim 1 wherein said solvent capable of dissolving carbon monoxide is restrained within a vehicle.

7. The method of claim 1 wherein said gas containing hydrogen, substantially devoid of carbon monoxide containing solvent and containing carbon dioxide, is scrubbed with a solution capable of separating carbon dioxide from said gas and separated from the solution containing scrubbed carbon dioxide to produce a gas containing hydrogen substantially devoid of carbon dioxide and solvent.

8. The method of claim 7 wherein said solution capable of separating carbon dioxide is selected from the group consisting of aqueous bases and aqueous salts including an individual or a combination thereof.

9. The method of claim 7 wherein said solution capable of separating carbon dioxide contains salts derived from said solvent.

10. The method of claim 7 wherein the previously separated solution capable of separating carbon dioxide, containing scrubbed carbon dioxide, gaseous carbon dioxide is substantially released from the solution to furnish a solution for recycle capable of separating carbon dioxide.

11. The method of claim 7 wherein said gas containing hydrogen substantially devoid of carbon monoxide and substantially devoid of carbon dioxide substantially devoid of solvent supplies hydrogen to power a fuel cell located within a vehicle.

12. The method of claim 7 wherein said gas containing hydrogen substantially devoid of carbon monoxide and substantially devoid of carbon dioxide substantially devoid of solvent containing hydrogen is concentrated by an adsorbent selected from the group consisting of activated charcoal and structured carbon including an individual or a combination thereof.

13. The method of claim 12 wherein the adsorbed hydrogen is released it a rate substantially regulated upon demand.

14. The method of claim 1 wherein the rate of said reformer gas is substantially regulated upon demand.

15. The method of claim 1 wherein said heterocyclic vapor and water vapor are subjected to temperature control to sustain production of hydrogen.

16. The method of claim 1 wherein the catalysts for reforming and catalysts for steam shifling are combined.

17. The method of claim 1 wherein said volatile heterocycic compounds are provided by acidic hydrolysis within a biomass.

* * * * *